US005888314A

United States Patent [19]

Ushigami et al.

[11] Patent Number: 5,888,314

[45] Date of Patent: Mar. 30, 1999

[54] PROCESS FOR PREPARATION OF ORIENTED ELECTRICAL STEEL SHEET HAVING HIGH FLUX DENSITY

[75] Inventors: Yoshiyuki Ushigami, Kitakyushu; Fumio Kurosawa; Hajime Komatsu, both of Kawasaki, all of Japan

[73] Assignee: Nippon Steel Corporation, Tokyo, Japan

[21] Appl. No.: 185,298

[22] Filed: Jan. 21, 1994

Related U.S. Application Data

[63] Continuation of Ser. No. 819,371, Jan. 6, 1992, abandoned.

[30] Foreign Application Priority Data

Jan. 8, 1991 [JP] Japan ..... 3-000749

[51] Int. Cl.[6] ..... H01F 1/04

[52] U.S. Cl. ..... 148/113; 148/111

[58] Field of Search ..... 148/113, 111

[56] References Cited

U.S. PATENT DOCUMENTS

| | | | |
|---|---|---|---|
| 4,929,286 | 5/1990 | Komatsu et al. | 148/113 |
| 5,049,205 | 9/1991 | Takahashi et al. | 148/111 |
| 5,082,509 | 1/1992 | Ushigami et al. | 148/113 |

FOREIGN PATENT DOCUMENTS

| | | | |
|---|---|---|---|
| 0219611 | 4/1987 | European Pat. Off. . | |
| 0318051 | 5/1989 | European Pat. Off. . | |
| 0339474 | 11/1989 | European Pat. Off. . | |
| 2262703 | 9/1975 | France . | |
| B30-3651 | 5/1955 | Japan . | |
| B40-15644 | 7/1965 | Japan . | |
| 46-937 | 1/1971 | Japan | 148/113 |
| B51-13469 | 4/1976 | Japan | C21D 9/00 |
| 54-40227 | 3/1979 | Japan | 148/113 |
| B62-45285 | 9/1987 | Japan | C21D 8/12 |
| A1-91956 | 4/1989 | Japan | B22D 27/20 |
| A1-139722 | 6/1989 | Japan | C21D 8/12 |

OTHER PUBLICATIONS

J.E. May. D. Turnbull (Trans. Met. Soc. AIME 212 (1958) pp. 769/781).

Trans. of Japanese Metal Association, vol. 27 (1963) pp. 186/195.

Iron & Steel, vol. 53 (1967) pp. 1007/1023.

Trans. of Japan Metal Association, vol. 43 (1979). pp. 175/181.

*Primary Examiner*—Sikyin Ip

*Attorney, Agent, or Firm*—Kenyon & Kenyon

[57] ABSTRACT

In a process for the preparation of oriented electrical steel sheet having a high magnetic flux density a primary recrystallization annealed steel sheet is nitrided for a short period of time in a temperature range of 800° C. or less whereby growth of crystal grains does not substantially occur. The nitrided sheet is held at a temperature range of 700° C. to 800° C. for at least four hours during temperature raising to final annealing temperature whereby nitride formed by the nitriding dissolves and re-precipitates allowing the nitride to transform to a thermally stable nitride containing aluminium.

3 Claims, 5 Drawing Sheets

ELEMENT ANALYSIS : COARSE BLOCK-SHAPED PRECIPITATED SUBSTANCE

ELEMENT ANALYSIS : NEEDLE-SHAPED PRECIPITATED SUBSTANCE

PROCESS FOR PREPARATION OF ORIENTED ELECTRICAL STEEL SHEET HAVING HIGH FLUX DENSITY

This application is a continuation of application Ser. No. 07/819,371 filed on Jan. 6, 1992, now abandoned.

BACKGROUND OF THE INVENTION

1. Field of the Invention

The present invention relates generally to a process producing oriented electrical steel sheet having a high magnetic flux density. More particularly, the present invention relates to a process of producing oriented electrical steel sheet of the type wherein most of crystal grains is aligned with each other with a certain specific orientation such as (110) <001>, (100) <001> or the like represented by a mirror index.

The steel sheet produced by employing the process of the present invention is used as soft magnetic material for producing cores for various kinds of electric apparatuses, electric equipment or the like.

2. Description of the Prior Art

Oriented electrical steel sheet has a structure composed of crystal grains aligned with each other with a specific orientation as mentioned above wherein each steel sheet usually contains Si of 4.8% or less and has a thickness ranging from 0.10 to 0.35 mm. These steel sheet is required to have excellent magnetizing properties and iron loss properties as magnetic properties. To satisfactorily meet the requirement, it is important that crystal grains are aligned with each other with an exact orientation. Integral alignment of the crystal grains with each other with the specific crystal orientation has been accomplished by utilizing a phenomenon of catastrophic grain growth called secondary recrystallization.

To properly control the secondary recrystallization, it is necessary that a primarily recrystallized structure is properly adjusted prior to the secondary recrystallization, and moreover, a fine precipitated substance called an inhibitor or a grain boundary segregated type element is properly adjusted prior to the secondary recrystallization. The inhibitor has a function of suppressing the growth of general primarily recrystallized grains in a primarily recrystallized structure to thereby selectively grow crystal grains each having a certain specific orientation.

According to the reports given by M. F. Littman (official gazette of Japanese Examined Publication Patent (Kokoku) No. 30-3651) and J. E. May and D. Turnbull (Trans. Met. Soc. AIME 212 (1958) P769/781), MnS is noted as a typical precipitated substance. In addition, according to the report given by Taguchi and Sakakura (official gazette of Japanese Examined Publication Patent (Kokoku) No. 40-15644), AlN is noted as a typical precipitated substance. Additionally, according to the report given by Imai et al. (official gazette of Japanese Examined Publication Patent (Kokoku) No. 51-13469), MnSe is noted as a typical precipitated substance. Further, Komatsu et al. reported that (Al, Si)N is a typical precipitated substance.

On the other hand, according to the report given by Saito (Trans. of Japanese Metal Association, Vol. 27 (1963) P186/195), Pb, Sb, Nb, Ag, Te, Se and S are noted as grain boundary segregated type elements but they are used practically merely as an assistant for the inhibitor on an industrial basis.

At present, it is not necessarily clarified what the necessary conditions are for allowing each of the above-noted precipitated substances to function as an inhibitor but it is considered based on the results obtained from the reports given by Matsuoka (Iron & Steel, Vol. 53 (1967) P1007/1023) and Kuroki et al. (Trans. of Japan Metal Association, Vol. 43 (1979) P175/181) and (Trans. of the same, Vol. 44 (1980) P419/427) that the following conditions are necessary for the same purpose as mentioned above.

(1) A sufficient quantity of fine precipitated substance enough to suppress growth of primarily recrystallized grains is present prior to secondary recrystallization.

(2) Each precipitated substance has a considerably large size, and moreover, it is not thermally transformed at an excessively high rate during a secondary recrystallization annealing operation.

At present, the following three kinds of methods can each be noted as typical methods for producing grain oriented electrical steel sheets on an industrial basis.

Specifically, a first prior technology is disclosed in an official gazette of Japanese Examined Publication Patent (Kokoku) No. 30-3651 of M. F. Littmann wherein MnS is used as a precipitated substance to enable a hot rolled sheet to be subjected to cold rolling twice, a second prior technology is disclosed in an official gazette of Japanese Examined Publication Patent (Kokoku) No. 40-15644 of Taguchi and Sakakura wherein AlN+MnS are used as precipitated substances to enable a cold rolled sheet to be subjected to final cold rolling at a high reduction ratio exceeding 80%, and a third prior technology is disclosed in an official gazette of Japanese Examined Publication Patent (Kokoku) No. 51-13469 of Imanaka et al. wherein MnS (or MnSe)+Sb are used as precipitated substances so as to enable a hot rolled sheet to be subjected to cold rolling twice.

To satisfactorily meet the requirements for assuring a quantity of precipitated substance and minimizing it in size, each of the aforementioned prior technologies is practiced based on the fundamental technical concept that an inhibitor is prepared by heating a slab of silicon steel up to an elevated temperature exceeding 1270° C. prior to a hot rolling operation.

However, when the slab is heated to an elevated temperature as mentioned above, the following problems occur.

1) It is necessary that a high temperature slab heating furnace exclusively employable for producing oriented electrical steel sheets be installed in a steel plant.

2) The energy unit cost required for operating the slab heating furnace is high.

3) The surface of each slab is promotively oxidized and a molten material called slag appears, resulting in adverse operation of the slab heating furnace.

To obviate the above problems, there has arisen a necessity for developing a technology for preparing an inhibitor without the need of heating a slab to an unusually high temperature.

Some of the inventors have proposed a method of preparing an inhibitor by performing a nitriding operation, as disclosed in an official gazette of Japanese Examined Publication Patent No. (Kokoku) No. 62-45285 (grain oriented electrical steel sheet) and official gazette of Japanese Unexamined Publication Patent (Kokai) No. 1-139722 (double oriented electrical steel).

A significant feature of the proposed process is that inhibitors are uniformly precipitated and dispersed in the steel sheet. However, when the process is practiced on an industrial scale, it was found that if the nitriding operation is irregularly performed in the longitudinal direction of a coil or in the transverse direction of the same, magnetic properties of the steel sheet become correspondingly irregular.

In view of the aforementioned problem, a proposal has been made regarding a method of nitriding a steel sheet (strip) using a gas such as an ammonia gas or the like having a nitriding function, as disclosed in an official gazette of Japanese Unexamined Publication Patent (Kokai) No. 1-91956. This prior invention makes it possible to uniformly nitride a steel sheet in the longitudinal direction of a coil and also in the transverse direction of the same.

However, even when a steel sheet is uniformly nitrided in the longitudinal direction of a coil and in the transverse direction of the same, a satisfactory secondary recrystallizing operation does not necessarily occur for reasons that have not been made clear in the past.

The present invention has been made with the above background in mind and its object resides in clarifying the essential reason why a satisfactory secondary recrystallizing operation does not in some cases occur. Another object of the present invention is to present operational conditions for assuring that a satisfactory and stable secondary recrystallizing operation does occur.

SUMMARY OF THE INVENTION

The inventors conducted a number of experiments to examine factors causing magnetic instability with oriented electrical steel sheets, and it has been determined based on the results derived from the said experiments that the following two facts are associated with the main factors causing magnetic instability.

(1) There are occasions when a primarily recrystallized structure is transformed during a nitriding operation, and a part of the primarily recrystallized structure is coarsened.

(2) There are occasions when a nitride formed by a nitriding operation within a short period of time is present only in a region in the vicinity of the surface of a steel sheet, the nitride hardly contributes to substantial suppression of grain growth of primarily recrystallized grains in the central layer of the steel sheet, the nitride is not thermally stable, and most of the nitride is decomposed until the temperature is raised to 900° C., and moreover, the nitride cannot sufficiently suppress growth of primarily recrystallized grains during a secondary recrystallizing operation performed within the temperature range exceeding 900° C.

The inventor has invented the present invention based on the results derived from the aforementioned experiments in consideration of operational conditions for producing oriented electrical steel sheets each having a high magnetic flux density.

The purport of the present invention will be described below.

(1) A process for preparation of oriented electrical steel sheet having a high magnetic flux density wherein after a slab of silicon steel having a composition comprising Si: 0.8 to 4.8% by weight, acid soluble Al: 0.012 to 0.050% by weight, N≦0.01% by weight and balance comprising Fe and unavoidable impurities are heated to a temperature of 1270° C. or less, subjected to hot rolling, thereafter, as desired, the hot rolled sheet is annealed, thereafter, it is subjected to cold rolling once or at least twice with intermediate annealing to obtain a final thickness, subsequently, the cold rolled sheet is subjected to primary recrystallization annealing, the annealed cold rolled sheet is then coated with an annealing separating agent, and finally, it is subjected to finish annealing, wherein the method is characterized in that after a crystal grain structure of the cold rolled sheet is properly adjusted by performing a primary recrystallization annealing it is nitrided for a short period of time within the temperature range of 800° C. or less where growth of crystal grains does not substantially occur, and thereafter, it is kept still for at least four hours within a temperature range of 700° to 800° C. during the temperature raising step for the finish annealing so that a nitride formed by the nitriding operation is solid-dissolved and re-precipitated to allow the nitride to be transformed into a thermally stable nitride containing an aluminum.

(2) A process for the preparation of oriented electrical steel sheet having a high magnetic flux density as claimed in claim 1, wherein the method is characterized in that a partial pressure of nitrogen within the temperature range of 700° to 800° C. where the nitride, formed by the nitriding operation is dissolved and re-precipitated, is set during the temperature raising step for the finish annealing to be 10% or more.

DESCRIPTION OF THE PREFERRED EMBODIMENTS

The present invention will be described in more detail below.

First, the inventors conducted a variety of research experiments on the behavior of the growth of primarily recrystallized grains, and they discerned, based on the results derived from the research, that the growth of crystal grains could be avoided by the nitriding operation within the temperature range of 800° C. or less, whereby the crystal grain structure could be maintained in an adequate state by a primary recrystallization annealing operation.

The aforementioned knowledge was obtained based on the following experiments conducted by the inventors.

A hot rolled silicon steel sheet having a composition comprising Si: 3.3% by weight, acid soluble Al: 0.027% by weight, N: 0.008% by weight, Mn: 0.14% by weight, S: 0.008% by weight, C: 0.05% by weight and a balance of Fe and unavoidable impurities were annealed at a temperature of 1100° C. for two minutes. Thereafter, the annealed steel sheet was subjected to cold rolling to a final thickness of 0.20 mm. The cold rolled steel sheet was then subjected to primary recrystallization annealing in an atmosphere of a wet hydrogen at a temperature of 830° C. for two minutes also for the purpose of decarburizing the steel sheet.

Further, the annealed cold rolled steel sheet was additionally annealed in an argon atmosphere without a nitriding operation. After completion of the annealing operation, the behavior of the growth of crystal grains in the steel sheet was examined.

Figure 1:
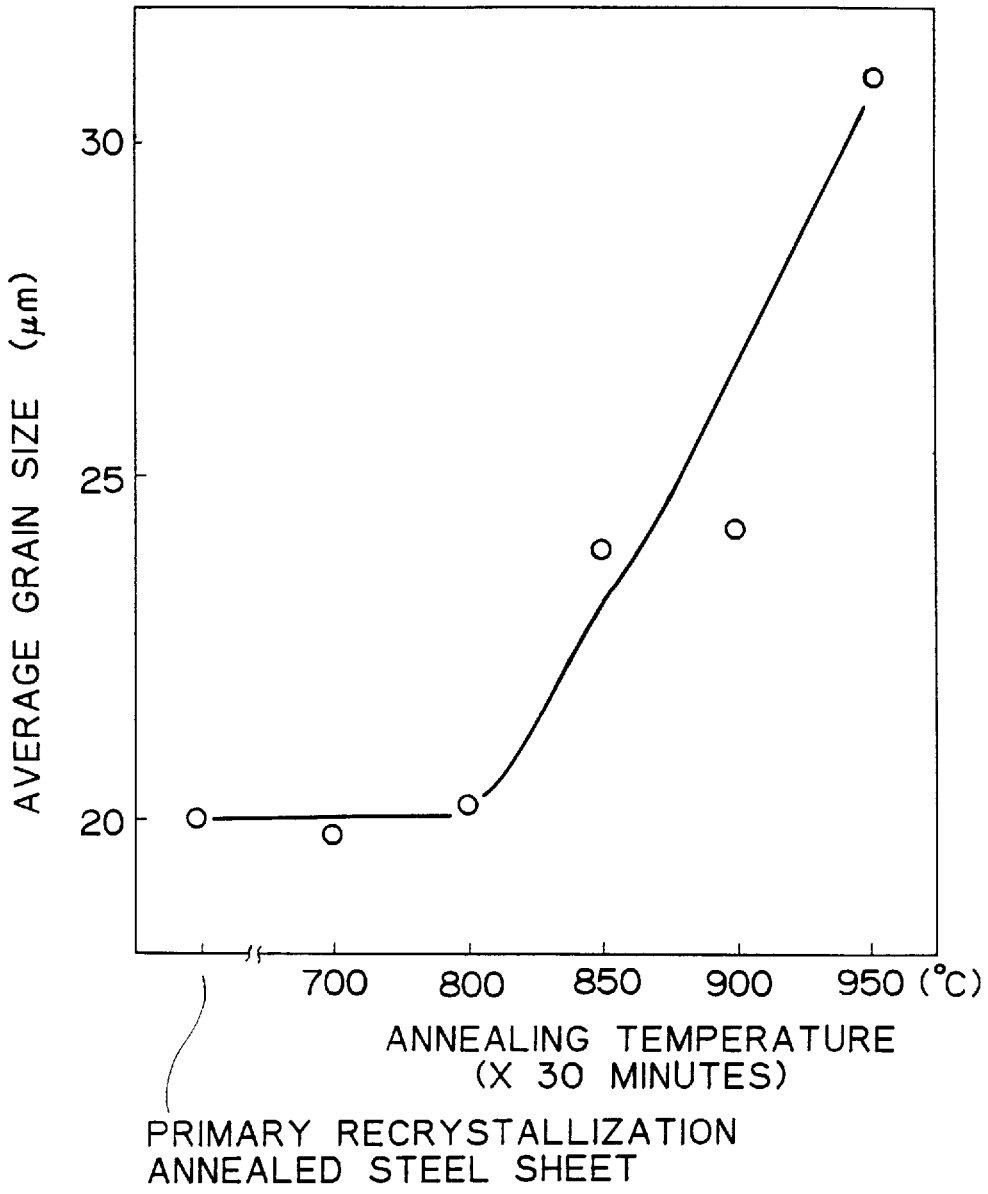
FIG. 1 is a diagram illustrating grain growth behavior of primarily recrystallized grains with annealing temperature.

As is apparent from FIG. 1, growth of crystal grains does not substantially occur within the temperature range of 800° C. or less. Consequently, after completion of the primary recrystallization annealing operation, the primarily recrystallized structure of the steel sheet could be maintained in an adequately adjusted state by the nitriding operation within the temperature range of 800° C. or less.

As mentioned above, the primarily recrystallized structure of the steel sheet is a significant factor from the viewpoint of properly controlling the secondary recrystallizing operation, and an adequate range acceptable for the steel sheet is disclosed in specifications of Japanese Patent Application Nos. 1-1778, 1-79992 and others.

Next, the primarily recrystallized steel sheet was annealed at a temperature of 750° C. for one minute in an atmosphere containing an ammonia gas, and a nitride formed by the annealing operation in that way was examined with the annealed steel sheet.

Figure 2:
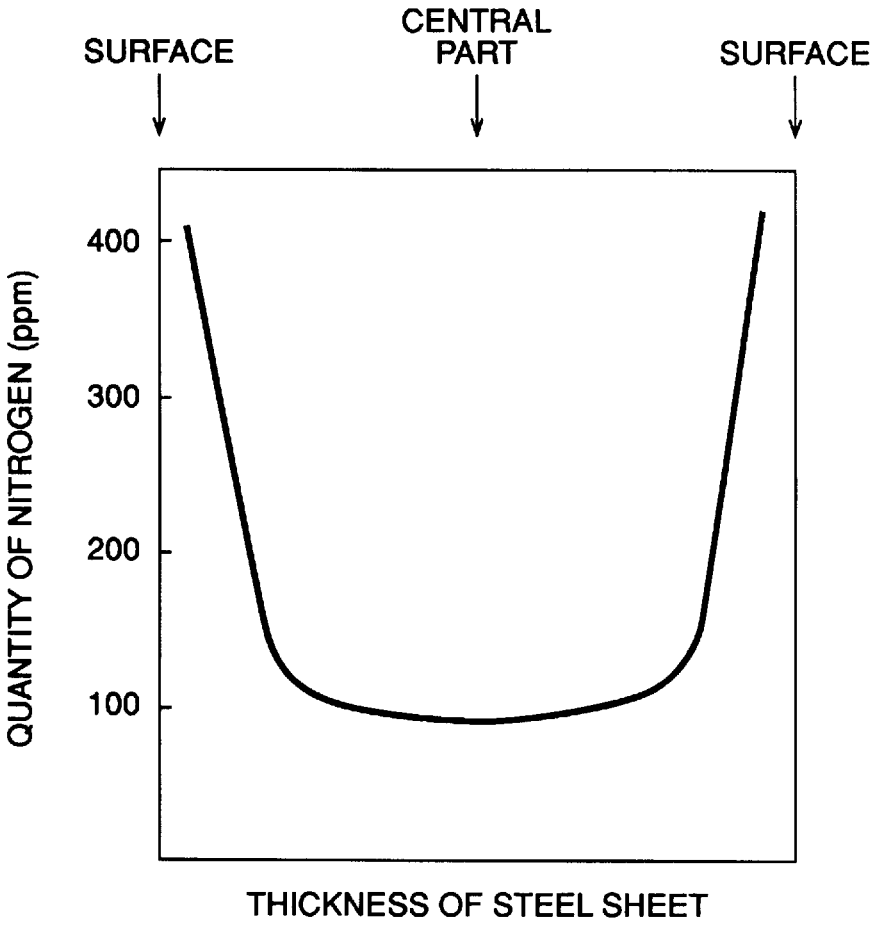
FIG. 2 is a diagram illustrating the distribution of nitrides formed by a nitriding operation.
Figure 3:
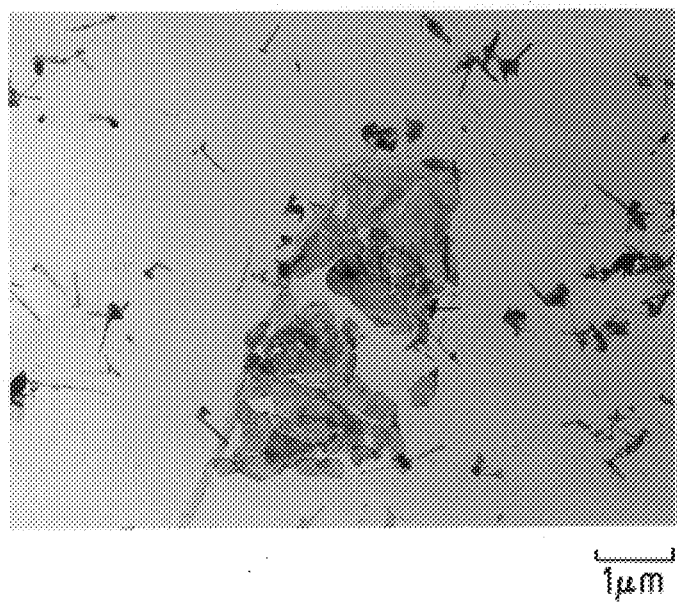
FIG. 3 is a photograph taken by electron microscope, illustrating the metallurgical structure of nitrides formed by a nitriding operation.
Figure 4:
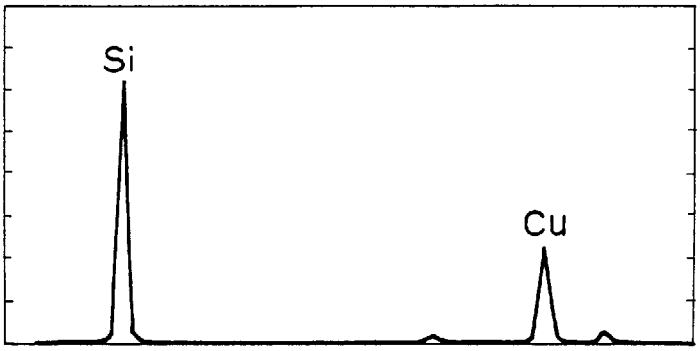
FIG. 4 is a diagram illustrating the results derived from element analysis conducted by EDAX for detecting a coarse block-shaped precipitated product (wherein Cu is detected by using a copper mesh).
Figure 5:
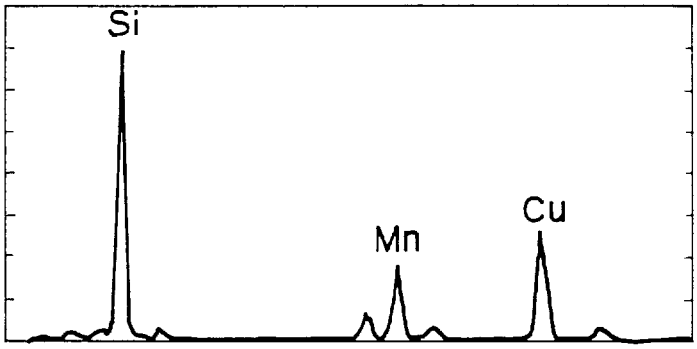
FIG. 5 is a diagram similar to FIG. 4 illustrating the results derived from element analysis conducted by EDAX for detecting a needle-shaped precipitated product (wherein Cu is detected by using a copper mesh).

FIG. 2 is a diagram illustrating the distribution of nitrogen in the direction of a thickness of the steel sheet by way of chemical analysis, and FIG. 3 is a microscopical photograph taken by an electron microscope showing, for example, the metallurgical structure of a nitride.

As is apparent from FIG. 2 to FIG. 5, the nitride formed by performing a nitriding operation is composed mainly of $Si_3N_4$ or (Si, Mn)N, and it is precipitated only in the region in the vicinity of the surface of the steel sheet. In addition, it was found that each of the nitrides mentioned above was not thermally stable and it was decomposed during the temperature raising step for the finish annealing operation until the temperature was elevated to about 900° C.

In practice, though the nitriding operation made it possible to uniformly control a quantity of nitrogen in the longitudinal direction of the steel sheet and also in the transverse direction of the same there remained the problems that (1) the nitride was not uniformly distributed in the direction of a thickness of the steel sheet and (2) each of the nitrides was not a thermally stable nitride containing an aluminum such as AlN, (Al, Si)N or the like.

It is considered that the reason of these problems is that since the quantity of nitrogen dissolved in the steel sheet is small and the nitrogen diffuses in the steel sheet at a low speed during a nitriding operation for a short period of time at a temperature of 800° C. or less, the nitrogen reacts with a large quantity of silicon present in the steel sheet in a region in the vicinity of the surface of the steel sheet and a thermally unstable nitride of $Si_3N_4$ or (Si, Mn)N is formed before a thermally stable nitride containing an aluminum is formed.

Figure 6:
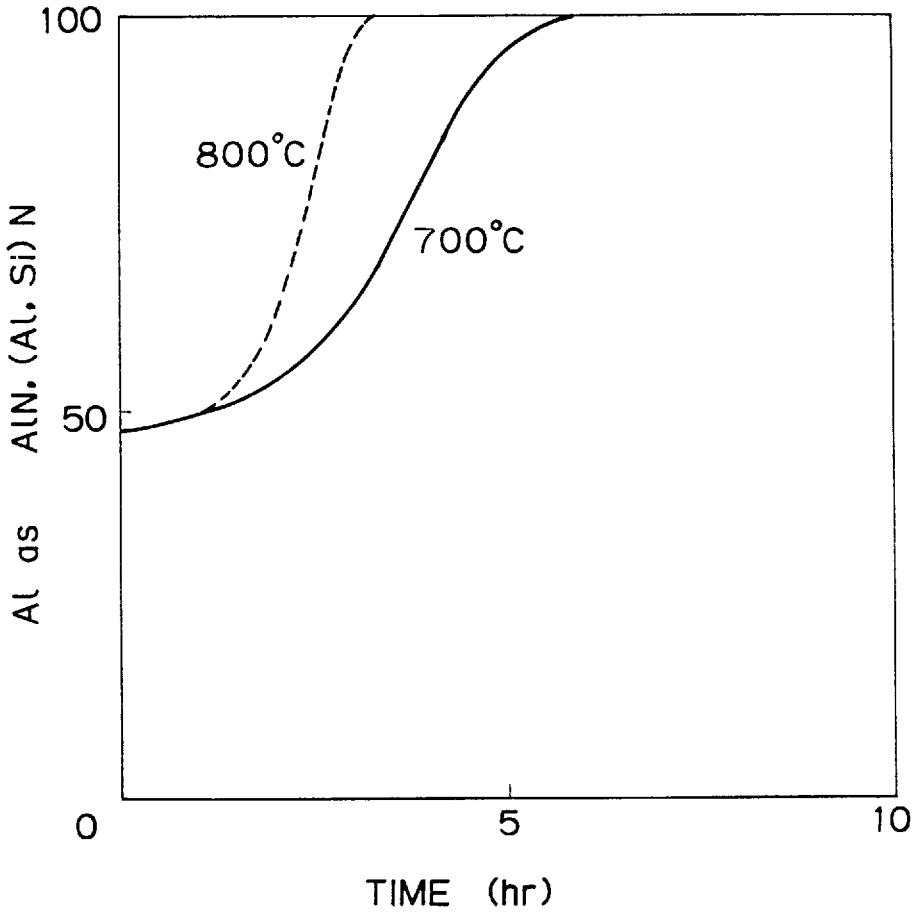
FIG. 6 is a diagram illustrating behavior such that $Si_3N_4$ or (Si, Mn)N formed by a nitriding operation is dissolved and then re-precipitated in the form of AlN, (Al, Si)N.

Accordingly, to assure that the thermally unstable nitride such as $Si_3N_4$ , (Si, Mn)N or the like is transformed into a thermally stable nitride such as AlN, (Al, Si)N or the like and moreover these thermally stable nitrides are precipitated in the whole region of the steel sheet across its thickness, it is necessary to properly control a secondary recrystallizing operation. In view of the aforementioned necessity, the inventors conducted a variety of experiments on the nitrides as mentioned above, and discerned, based on the results derived from the research, that it was acceptable that the steel sheet was kept still at least four hours within the temperature range of 700° to 800° C. so that the thermally unstable nitride of $Si_3N_4$ or (Si, Mn)N was decomposed and the thermally stable nitride of AlN, (Al, Si)N or the like was re-precipitated in the whole region of the steel sheet, as shown in FIG. 6.

When the steel sheet is held within the temperature range lower than 700° C., decomposition of the thermally unstable nitride of $Si_3N_4$ , (Si, Mn)N or the like and dispersion of a nitrogen into the steel sheet take a long time. For this reason, the aforementioned temperature range is not advantageously employable on an industrial basis. On the contrary, when the steel sheet is held within the temperature range exceeding 800° C., the thermally unstable nitride of $Si_3N_4$ , (Si, Mn)N or the like is quickly decomposed, and there occurs the case where a nitrogen disappears from the steel sheet. As mentioned above, there arises the case where a structure of primarily recrystallized crystal grains is transformed and a secondary recrystallizing operation is unstably performed. In this case, it is effectively acceptable that a nitrogen is introduced into the atmosphere for the steel sheet during the secondary recrystallizing operation to avoid an occurrence of denitrization of the steel sheet. In addition, to ensure that each of the nitrides is stably dissolved and re-precipitated in the steel sheet, it is acceptable that a partial pressure of the nitrogen is set to 10% or more, preferably 25% or more.

As is apparent from the above description, there has not been hitherto disclosed the technical concept of the present invention such that dissolution and re-precipitation are utilized so that the precipitated substance such as $Si_3N_4$ , (Si, Mn)N or the like is transformed into AlN, (Al, Si)N or the like to allow an inhibitor to perform its own roles of (1) excellent uniformity (in view of thickness distribution) and (2) excellent thermal stability.

Next, the best mode for carrying out the present invention will be described below.

According to the present invention, a slab of silicon steel has a composition comprising Si: 0.8 to 4.8% by weight, acid soluble Al: 0.012 to 0.050% by weight, $N \leqq 0.01\%$ by weight and a balance of Fe and unavoidable impurities. The aforementioned components are essential, and nothing has been defined with respect to components other those aforementioned.

A silicon is an important element for elevating electrical resistance and lowering iron loss of the steel sheet. When a content of the silicon exceeds 4.8% by weight, the steel sheet is liable to crack during a cold rolling operation. Once cracking occurs, a rolling operation cannot be performed. On the other hand, when the content of the silicon is excessively lowered, an $\alpha$ phase in the steel sheet is transformed into a $\gamma$ phase, resulting in an orientation of crystal grains being affected adversely. For this reason, the content of the silicon has a lower limit of 0.8% by weight, which has no substantial effect on the orientation of crystal grains.

As mentioned above, the acid soluble aluminum is an essential element allowing it to be chemically bonded to a nitrogen to thereby form AlN or (Al, Si)N, which in turn functions as an inhibitor. In practice, a content of the acid soluble aluminum is to remain within the range of 0.012 to 0.050% by weight wherein the product of the steel sheet has a high magnetic flux density.

When a content of the nitrogen exceeds 0.01% by weight, a void called a blister appears in the steel sheet. For this reason, a content of the nitrogen has an upper limit of 0.01% by weight. Since the nitrogen can later be added to the steel sheet after completion of the nitriding operation, no definition has been made with respect to a lower limit regarding the content of the nitrogen.

In addition, Mn, S, Se, B, Bi, Nb, Sn, Ti or the like can be added to the steel sheet as elements each constituting an inhibitor.

A slab of silicon steel is produced by melting ferrous materials in a converter, an electric furnace or the like, and as desired, the molten steel is subjected to degassing by actuating a vacuum pump. Subsequently, the molten steel is continuously cast to produce slabs. Alternatively, an ingot produced by casting the molten steel in an ingot case may be delivered to a blooming mill to produce slabs by a hot rolling operation.

According to the present invention, it is desirable that each slab is heated to a temperature of 1270° C. or less, because a quantity of thermal energy consumed when heating the slab can be reduced, and moreover, various problems associated with installations in a steel plant can be avoided.

As desired, a hot rolled sheet or a continuously cast sheet is annealed within the temperature range of 750° to 1200° C. for thirty seconds to thirty minutes, and thereafter, the annealed steel sheet is subjected to cold rolling by a single step of cold rolling or two or more steps of cold rolling with an intermediate annealing operation between adjacent cold rolling operations until a final thickness of the steel sheet is attained.

With respect to grain oriented electrical steel sheet, basically, cold rolling operations are performed at a final cold reduction ratio of 80% or more, as disclosed in an official gazette of Japanese Examined Publication Patent (Kokoku) No. 40-15644. With respect double oriented electrical steel sheets, cross cold rolling operations are performed with a reduction ratio of 40 to 80% employed therefor, as disclosed in official gazettes of Japanese Examined Publication Patent (Kokoku) Nos. 35-2657 and 38-8218.

After completion of the cold rolling operations, the steel sheet is usually subjected to primary recrystallization annealing in a wet atmosphere for the purpose of removing a carbon contained in the steel sheet as far as possible.

Here, it is necessary that conditions (temperature, time) for the annealing operation are determined such that a structure of primarily recrystallized grains conforms with adequate conditions as shown in specifications of Japanese Patent Application Nos. 1-1778 and 1-79992.

In addition, it is important that each inhibitor is strengthened by a nitriding operation and a secondary recrystallizing operation is then performed while the adequate primarily recrystallized structure is maintained. In this connection, the present invention has disclosed operational conditions for performing the secondary recrystallizing operation.

It is necessary that a nitriding operation is performed within the temperature range of 800° C. or less where primarily recrystallized grains are not undesirably transformed. It is desirable that a quantity of the nitriding operation be determined with a total quantity of nitrogen of 150 ppm or more in the steel sheet.

After completion of the nitriding operation, the steel sheet is covered with an annealing separating agent containing MgO as a main component, and thereafter, it is subjected to finish annealing. In addition, it is necessary that the steel sheet is held for at least four hours within the temperature range of 700° to 800° C. during the temperature raising step for the finish annealing operation so that distribution of the nitrides and a quality of the nitrides are changed to allow for a stable secondary recrystallizing operation.

Finally, it can be concluded that the method of the present invention assures that oriented electrical steel sheets each having a high magnetic flux density can stably be produced by additionally utilizing the technical concept as disclosed in specification of Japanese Patent Application Nos. 1-94412, 1-1778 and 1-79992.

The present invention will now be described in detail with reference to the following examples, that by no means limit the scope of the invention.

EXAMPLE 1

A slab of silicon steel having a composition comprising Si: 3.2% by weight, acid soluble Al: 0.028% by weight, N: 0.008% by weight, Mn: 0.13% by weight, S: 0.007% by weight, C: 0.05% by weight and a balance of Fe and unavoidable impurities were heated to an elevated temperature of 1150° C. Thereafter, the slab was subjected to hot rolling until the resultant hot rolled sheet had a thickness of 1.8 mm. After the hot rolled sheet was first annealed at a temperature of 1120° C. for two minutes and subsequently annealed at a temperature of 900° C. for two minutes (two-stepped annealing), it was subjected to cold rolling to have a final thickness of the steel sheet of 0.02 mm. The cold rolled sheet was subjected to primary recrystallization annealing at a temperature of 830° C. for two minutes in a wet atmosphere also for the purpose of decarburizing the steel sheet.

Subsequently, the cold rolled sheet was nitrided at a temperature of 750° C. for thirty seconds in an atmosphere containing an ammonia gas. After completion of the nitriding operation, it was found that a quantity of nitrogen amounted to 190 ppm. After the steel sheet was coated with an annealing separating agent containing MgO as a main component, it was subjected to final annealing.

The final annealing operation was performed in an atmosphere containing 25% $N_2$+75% $H_2$ in accordance with the following three cycles.

(A) The steel sheet was heated to a temperature of 1200° C. at a rate of 30° C./hr.

(B) The steel sheet was heated to a temperature of 750° C. at a rate of 30° C./hr, it was kept at a temperature of 750° C. for 10 hours, and thereafter, it was heated again to a temperature of 1200° C. at a rate of 30° C./hr.

(C) The steel sheet was heated to a temperature of 1200° C. at a rate of 15° C./hr.

Thereafter, the aforementioned atmosphere was changed to an atmosphere containing 100% $H_2$ so that the steel sheet was subjected to purification annealing by holding it at a temperature of 1200° C. for twenty hours. Properties of the resultant products are as shown in Table 1.

TABLE 1

| cycle employed for finish annealing operation | Magnetic flux density B8 (Tesla: n = 10) | |
|---|---|---|
| A | 1.85 ($\sigma$ = 0.12) | comparative example |
| B | 1.91 ($\sigma$ = 0.02) | example of the present invention |
| C | 1.92 ($\sigma$ = 0.02) | example of the present invention |

EXAMPLE 2

A slab of silicon steel having a composition comprising Si: 3.4% by weight, acid soluble Al: 0.023% by weight, N: 0.007% by weight, Mn: 0.14% by weight, S: 0.008% by weight, C: 0.05% by weight and a balance of Fe and unavoidable impurities was heated to an elevated temperature of 1150° C. Thereafter, it was subjected to hot rolling until the hot rolled sheet had a thickness of 1.8 mm. After the hot rolled sheet was annealed at a temperature of 1100° C. for two minutes, it was subjected to cold rolling at a roll-down rate of 55% applied in the same direction as that of the hot rolling operation. Additionally, it was subjected to cold rolling at a roll-down rate of 50% applied in the direction at a right angle relative to the direction of the preceding cold rolling operation until the steel sheet had a final thickness of 0.40 mm.

The cold rolled sheet was subjected to primary recrystallization annealing in a wet atmosphere at a temperature of 810° C. for ninety seconds also for the purpose of decarburizing the steel sheet.

Subsequently, the cold rolled sheet was subjected to plasma nitriding at a temperature of 100° C. After completion of the nitriding operation, it was found that a total quantity of nitrogen amounted to 170 ppm. After the cold rolled sheet was coated with an annealing separating agent, it was subjected to finish annealing in an atmosphere containing 25% $N_2$+75% $H_2$ under the following conditions.

(A) The steel sheet was heated to a temperature of 1200° C. at a rate of 50° C./hr.

(B) The steel sheet was heated to a temperature of 700° C. at a rate of 50° C./hr, and thereafter, it was heated further to reach a temperature of 1200° C. at a rate of 10° C./hr.

Thereafter, the atmosphere was changed to an atmosphere of 100% $H_2$ so that the steel sheet was subjected to purification annealing at a temperature of 1200° C. for twenty hours. Properties of the resultant products are as shown in Table 2.

TABLE 2

| cycle employed for finish annealing operation | magnetic flux density B8 (Tesla) in the direction of hot rolling | in the direction at a right angle relative to the direction of hot rolling |
|---|---|---|
| A | 1.80 | 1.75 |
| B | 1.92 | 1.91 |

As is apparent from the above description, the method of producing grain oriented electrical steel sheets each having a high magnetic flux density wherein a slab of silicon steel is heated at a lower temperature to enable production cost to be remarkably reduced according to the present invention assures that grain oriented electrical steel sheets each having a high magnetic flux density can be produced while an effective inhibitor is uniformly distributed in each of the steel sheets.

We claim:

1. A process for the preparation of an oriented electrical steel sheet having a high magnetic flux density comprising;

providing a steel slab having a composition consisting essentially of 0.8 to 4.8% by weight Si, 0.012 to 0.050% by weight of acid soluble Al; up to 0.01 by weight of N, balance Fe and unavoidable impurities;

heating said steel slab to a temperature of 1270° C. or less;

subjecting the heated slab to hot rolling to provide a hot rolled sheet;

cold rolling the hot rolled sheet at least once or at least twice with intermediate annealing to provide a cold rolled sheet of final thickness;

primary recrystallization annealing of the cold rolled sheet;

said process further comprising:

performing said primary recrystallization annealing to provide the cold rolled sheet with a selected crystal grain structure;

nitriding the primary recrystallization annealed sheet for a short period of time in a temperature range of 800° C. or less for precipitating nitride of $Si_3N_4$ or (Si,Mn)N, whereby growth of crystal grains does not substantially occur during said nitriding;

after completion of said nitriding, coating said nitrided sheet with an annealing separation agent;

after coating said nitrided sheet, holding the coated nitrided sheet at a temperature range of 700° C. to 800° C. for at least four hours during temperature raising to final annealing temperature whereby said $Si_3N_4$ or (Si,Mn)N nitride formed by the nitriding dissolves and re-precipitates allowing said nitride to transform to a thermally stable nitride of AlN or (Al,Si)N and said stable nitride of AlN or (Al,Si)N is uniformly distributed in the thickness direction of the steel sheet and growth of crystal grains does not substantially occur during said holding at 700° C. to 800° C. for at least four hours; and after said holding at 700° C. to 800° C. for at least four hours, heating said nitrided steel sheet to the final annealing temperature of about 1200° C. and holding said nitrided steel sheet at the final annealing temperature in a 100% $H_2$ atmosphere for purification.

2. A process for the preparation of an oriented electrical steel sheet having high magnetic flux density as claimed in claim 1 further comprising annealing said hot rolled sheet after hot rolling and prior to cold rolling.

3. A process for the preparation of an oriented electrical steel sheet having high magnetic flux density as claimed in claim 1 further comprising maintaining a partial pressure of nitrogen of 10% or more during said holding of said nitrided sheet at the temperature of 700° C. to 800° C. whereby the nitride formed by said nitriding dissolves and reprecipitates.

* * * * *